US005630538A

United States Patent [19]

Hatakeyama et al.

[11] Patent Number: 5,630,538

[45] Date of Patent: May 20, 1997

[54] FLEXIBLE TYPE CASTING GATE BREAKING MACHINE

[75] Inventors: Akiyoshi Hatakeyama, Tokyo; Isamu Takemoto, Hachinohe, both of Japan

[73] Assignees: Nippon Koshuha Steel Co., Ltd.; Koshuha Foundry Co. Ltd, both of Tokyo, Japan

[21] Appl. No.: 367,942

[22] Filed: Jan. 3, 1995

[30] Foreign Application Priority Data

Jul. 15, 1994 [JP] Japan ..... 6-185100

[51] Int. Cl.[6] ..... B22D 31/00; B26F 3/00

[52] U.S. Cl. ..... 225/103; 164/262

[58] Field of Search ..... 164/262, 265; 225/103

[56] References Cited

U.S. PATENT DOCUMENTS

| | | | |
|---|---|---|---|
| 4,299,347 | 11/1981 | Rougier | 225/103 X |
| 4,402,443 | 9/1983 | Kerns et al. | 225/103 |
| 4,915,156 | 4/1990 | Sandstad | 225/103 X |

FOREIGN PATENT DOCUMENTS

| | | | |
|---|---|---|---|
| 291948 | 7/1991 | Germany | 164/262 |
| 1526903 | 12/1989 | U.S.S.R. | 164/262 |
| 1600924 | 10/1990 | U.S.S.R. | 164/265 |
| 2172227 | 9/1986 | United Kingdom | 164/262 |

*Primary Examiner*—J. Reed Batten, Jr.

*Attorney, Agent, or Firm*—Lackenbach Diegel Marzullo Aronson & Greenspan, P.C.

[57] ABSTRACT

The machine consists of a bearing box which is secured onto the trunk of the machine and is equipped with a pair of axes at both sides and suspends the center of gravity of the machine to rotate same freely, and a U-type supporting device is installed at the axes respectively, and a revolving or swivel joint is installed at the upper end of the above supporting device so as to enable the machine to rotate freely.

1 Claim, 4 Drawing Sheets

FLEXIBLE TYPE CASTING GATE BREAKING MACHINE

BACKGROUND OF THE INVENTION

This invention relates to a flexible type casting-gate breaking machine which is used to detach a runner or a casting riser from a product at a location of the gate in a casting production process.

To cite an example, a conventional casting-gate breaking machine is presented in Japanese Utility Model Publication No. Showa 2-31250. This kind of casting-gate breaking machine has in such a structure a 30° suspension which suspends the hanger 1*a* at the rear end of the casting-gate breaking machine 3 with the coupling device 2 of a chain, rope or the like through the shackle , as shown in FIG. 4(*a*), or it has such a structure as a horizontal suspension which suspends the hanger 1*a* at the intermediate position of the casting-gate breaking machine 3 with the coupling device 2 of a chain, rope or the like through the shackle 4, as shown in FIG. 4(*b*).

Therefore, its working range is within a belt-shaped semi-circular area which inclines outside, as shown by the two dotted-chain line in the case of FIG. 4(*a*), or it is within a belt-shaped semi-circular area which is nearly vertical, as shown by the two dotted-chain line in case of FIG. 4(*b*).

In order to overcome the above disadvantages, the working range of the machine has been enlarged by installing the upper end of the coupling device 2 to the well known travelling pulley or to a conventional spring type balancer.

However, the usual casting-gate breaking machine as above mentioned has still the following defects:

(1) Because the suspending position of the suspension mechanism is at some distance from the center of gravity of the casting-gate breaking machine, its usable range is restricted under the influence of its empty weight.

(2) Because the flexibility of the suspension mechanism is not sufficient, the machine does not work in a certain direction when the head of edge plate is pushed between a riser and a product of casting.

(3) Because of the above disadvantages, such conventional casting-gate breaking machine is not applicable to a certain shape of casting. Further, a modification of the casting plan has been necessary even in a casting to which the machine is applied after making up for these defects.

This invention, therefore, provides for a flexible type casting-gate breaking machine which is made so as to suspend same at its center of gravity and to rotate freely at three positions.

SUMMARY OF THE INVENTION

This invention relates to a casting-gate breaking machine that consists of a ring shaped bearing box which is installed about the exterior periphery of the transverse section passing through the rough center of gravity of the machine trunk, so that the machine may rotate freely centering around the axial center of the machine. A U-type supporting device is fixed respectively to both sides of transverse axes meeting at right angles with the axial center of the ring shaped bearing box, and a revolving or swivel joint is installed at the upper end of the supporting device so as to enable the machine to rotate freely. The above revolving joint is suspended from a suitable connection with a coupling device of a chain, rope or the like.

Because the center of gravity of the machine (casting-gate breaking machine is generally rough on the axial center, the bearing rotates freely centering around this axial center the transverse axes of which are fixed to a supporting device at both sides passing through the center of gravity of the machine trunk and meeting at right angles with the axial center of the machine.

Further, the head of edge plate 21 moves approximately on a semi-spherical surface by the upward and downward movement of the machine head centering around the above axis and by the leftward and rightward movement of the machine head with the revolving Joint, as shown with two dotted-surface lines down in FIG. 2.

BRIEF DESCRIPTION OF THE DRAWING

FIG. 3(*b*) is a side view, thereof;

FIG. 3(*c*) is a front view, thereof; and

DETAILED DESCRIPTION OF THE INVENTION

Figure 1:
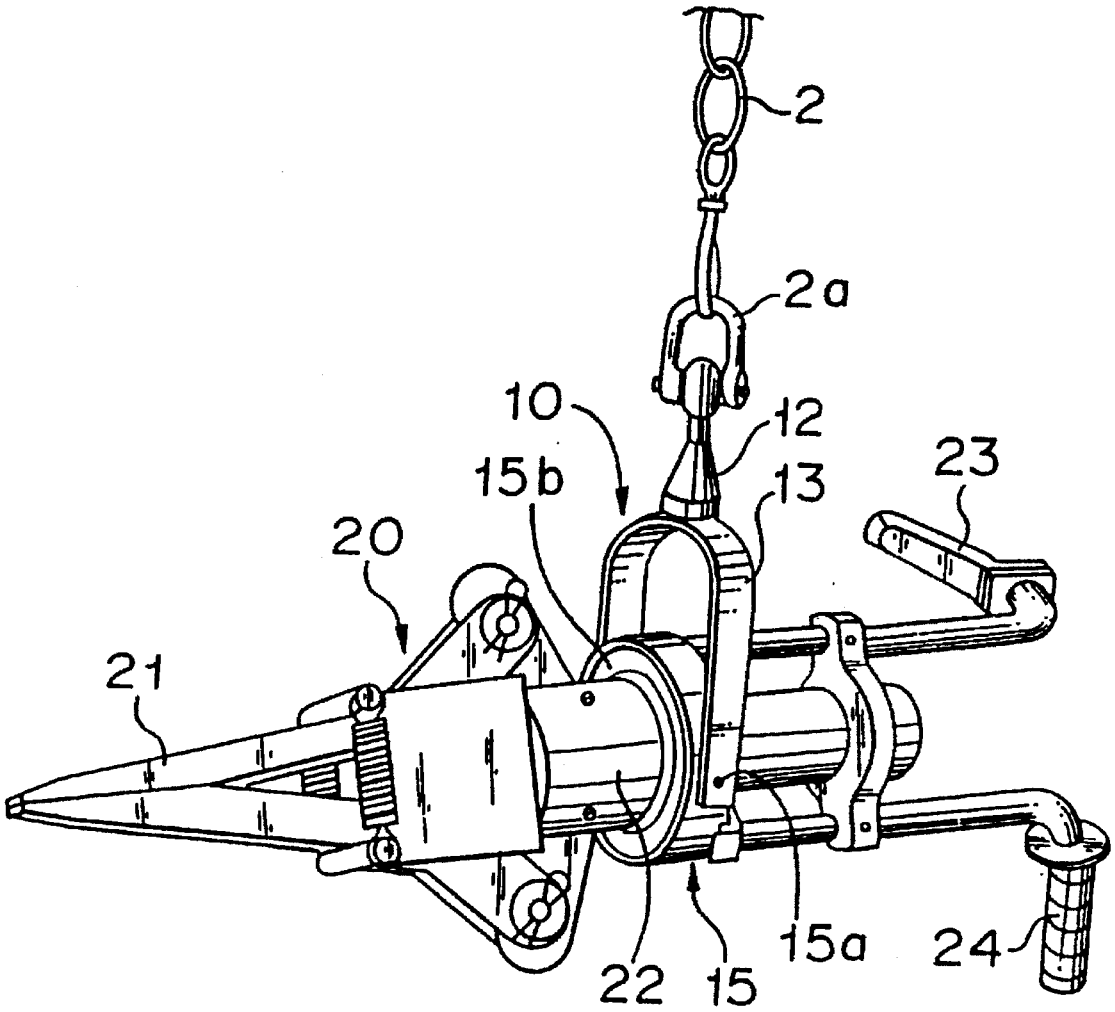
FIG. 1 is a perspective FIG. showing our novel invention.
Figure 2:
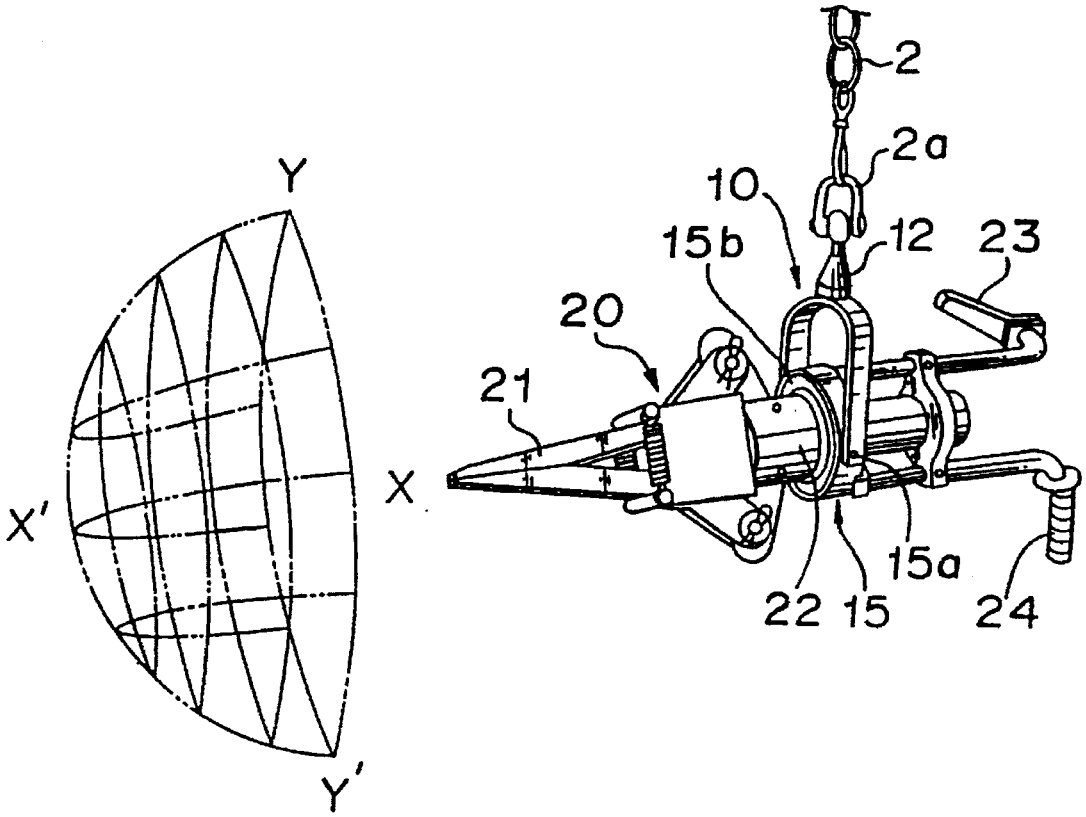
FIG. 2 is another perspective figure like that of FIG. 1, but showing the extensive working range.
Figure 3A:
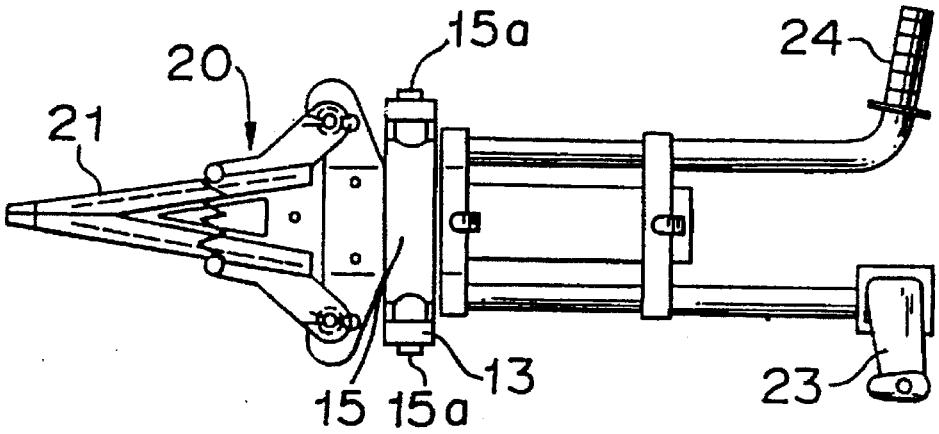
FIG. 3(*a*) is a bottom view, of the casting gate breaking machine shown in FIG. 1.
Figure 3B:
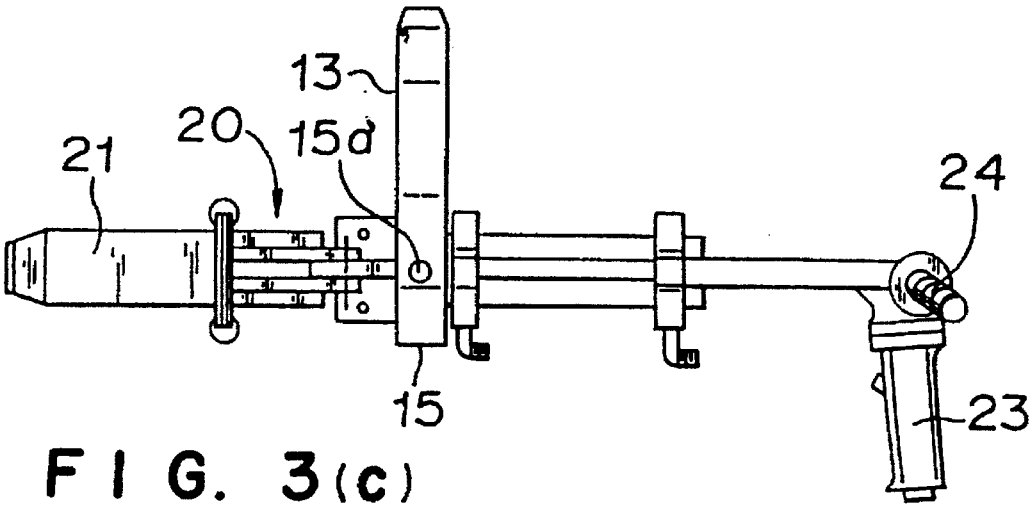
Figure 3C:
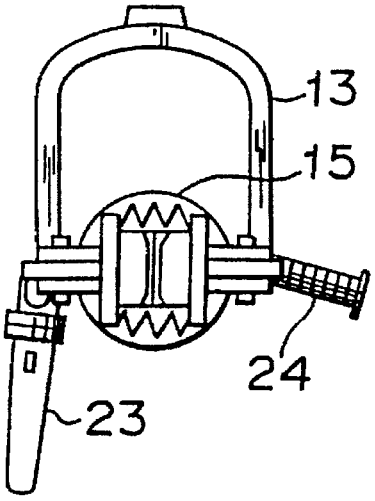
Figure 4A:
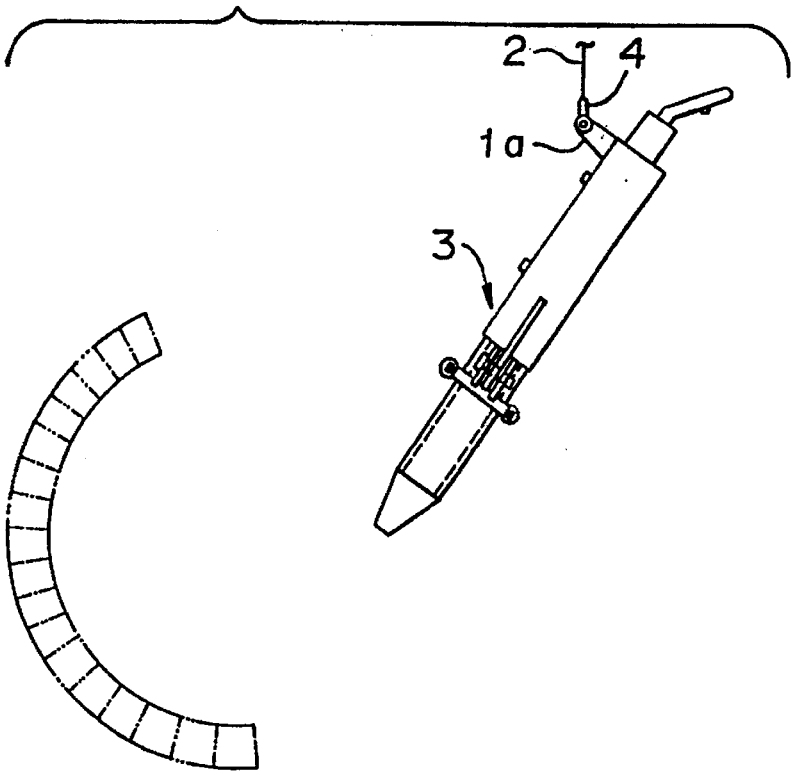
FIG. 4(a) (PRIOR ART)
FIGS. 4(*a*) and 4(*b*) are explanatory figures on the conventional casting-gate breaking machine, showing the hanging states of the 30° suspension and the horizontal suspension, respectively.
Figure 4B:
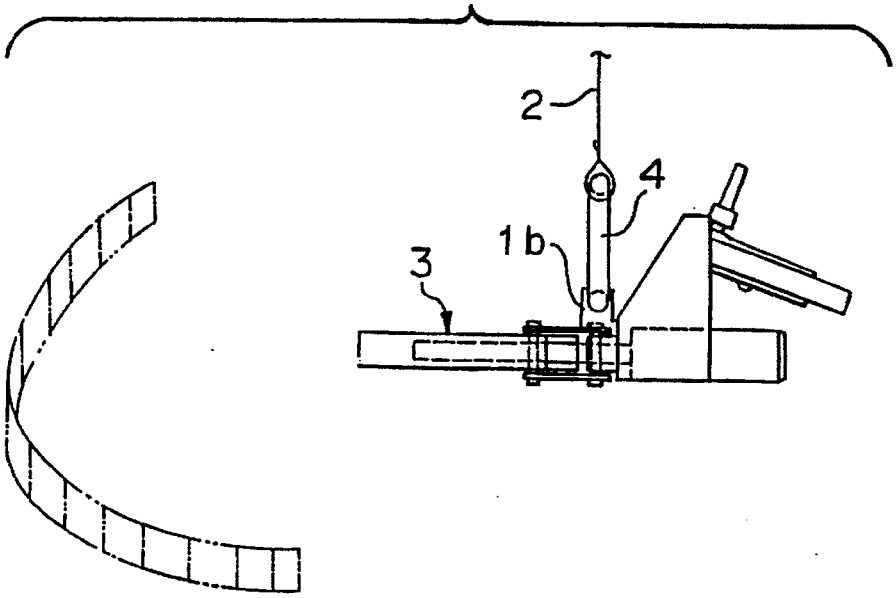
FIG. 4(b) (PRIOR ART)

On the basis of the appending figures, an illustration of this invention is described as follows:

In FIGS. 1, 2 and 3(*a*)–3(*b*), 20 is the machine (casting-gate breaking machine), 10 is the hanger and the bearing box 15 is installed about the exterior periphery of the transverse section passing through the center of gravity of the trunk 22 of the machine 20 in order to rotate freely centering around the axial center of the machine.

In this structure, the inner ring of the radial shaped rotating bearing 15 is secured into the exterior periphery of the machine trunk 22 and a pair of axes 15*a* are installed directly at the outer ring, or at the ring shaped hardware fixed to the outer ring.

The axes 15*a* meet at right angles with the axial center of the bearing box 15 (the axial center of the machine).

Element 13 is a U-shaped support installed at an axis 15*a* near so as to be freely rotatable thereabout.

The revolving joint 12 which rotates freely, is installed at the curved top end of the above supporting hardware 13.

The above revolving joint 12 is suspended from a fixing device (not shown here) by the chain 2 as a coupling device through the shackle 2*a*.

In this case, a rope or the like may be used in place of the chain 2 as the above coupling device.

In the FIGS. 23 is the manipulating handle and 24 is the shake-stopping handle.

The operation of the casting-gate breaking machine of this invention is described as follows:

As shown in FIG. 2, when the manipulating handle 23 and the shake-stopping handle 22 are grasped with the right hand and left hand respectively, and both hands are rotated, the machine 20 rotates around its axial center whereby the opening position of the edge plate 21 can be changed. Therefore, it is applicable to a runner or a riser in any direction such as X-X' or Y-Y' shown in FIG. 2.

Further, with grasping the handle 23 and 22, it is able to shift the machine in the upward and downward directions by rotating around the axis 15*a* and to shift it in the leftward and rightward directions by rotating around the revolving Joint 12. Furthermore, it is able to shift the machine in the oblique direction with grasping the handles 23 and 24. In this case, the axis 15*a* and the revolving joint 12 move at the same time. Therefore, the head of the edge plate 21 is able to move roughly on a semi-spherical surface, as shown with two dotted-chain line in FIG. 2.

Because the machine 20 is suspended with the chain 2, the above spherical surface moves in front and in the rear and also upward and downward, by shifting the machine 20 in front and in the rear and moreover by making the machine 20 possible to shift upward and downward with connecting the upper end of the chain 2 to a spring type balancer, thereby enlarging still more the working range of the machine.

According to this invention described above in detail, there is no limitation that is applicable only in a specific direction, unlike an usual machine. Further, the working range is enlarged from a belt-shaped scope to a scope with an area and it is enlarged still more by making use of a travelling pulley, a spring type balancer, a suspension chain or the like.

We claim:

1. The combination of a casting-gate breaking machine having a body portion with an outer surface, and a supporting device including:

a ring-shaped bearing installed on said outer surface of said body portion of said casting-gate breaking machine enabling rotation thereof around a central axis of said body portion;

a pair of pivot pins outwardly extending from said ring-shaped bearing;

a U-shaped supporting member having a top and having opposite arms with free ends for supporting said ring-shaped bearing by means of said pivot pins engaged at said free ends of said arms;

a horizontally rotatable coupling secured to the top of said U-shaped supporting member for freely rotating said U-shaped member;

a shackle connected to said rotatable coupling; and a flexible line connected to said shackle at a lower end and connected to a ceiling structure at an upper end thereof; whereby said breaking machine when in use and suspended from said ceiling structure by means of said flexible line and said rotatable coupling is capable of substantially omni-directional movement.

* * * * *